US007069850B2

(12) United States Patent
Nakamura et al.

(10) Patent No.: US 7,069,850 B2
(45) Date of Patent: Jul. 4, 2006

(54) STENCIL PRINTING MACHINE

(75) Inventors: Akira Nakamura, Ibaraki-ken (JP); Taku Naitou, Ibaraki-ken (JP); Takuya Shibahara, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 11/098,548

(22) Filed: Apr. 5, 2005

(65) Prior Publication Data

US 2005/0217517 A1 Oct. 6, 2005

(30) Foreign Application Priority Data

Apr. 6, 2004 (JP) ..... P2004-111827

(51) Int. Cl.
*B41L 13/00* (2006.01)
*B41L 13/06* (2006.01)
*B41L 13/08* (2006.01)
*B41F 15/38* (2006.01)

(52) U.S. Cl. ..... 101/119; 101/116; 101/120

(58) Field of Classification Search ..... 101/116, 101/119, 120
See application file for complete search history.

(56) References Cited

U.S. PATENT DOCUMENTS 3,949,666 A * 4/1976 Zimmer ..... 101/119
4,085,672 A * 4/1978 Grosart ..... 101/169
5,443,557 A * 8/1995 Hasegawa ..... 101/119
6,263,791 B1 * 7/2001 Sato ..... 101/116
6,382,097 B1 * 5/2002 Watanabe et al. ..... 101/129

FOREIGN PATENT DOCUMENTS

JP 07-132675 5/1995
JP 2001-246828 9/2001

* cited by examiner

*Primary Examiner*—Andrew H. Hirshfeld
*Assistant Examiner*—Marissa Ferguson-Samreth
(74) *Attorney, Agent, or Firm*—Nath & Associates PLLC; Gary M. Nath; Gregory B. Kang

(57) ABSTRACT

A stencil printing machine, which includes: a drum which is freely rotatable and has an outer peripheral wall formed of an ink impermeable member, in which a stencil sheet is mounted on a surface of the outer peripheral wall; an ink supplying device for supplying, to the surface of the outer peripheral wall, an ink guided from an ink tank; an ink recovery device for recovering, from an ink recovery portion, an extra ink on the surface of the outer peripheral wall; and a pressure roller which presses a print medium to the outer peripheral wall. The ink tank includes a main tank portion where unused ink is stored, and a sub-tank portion where the ink recovered by the ink recovery device is stored. The ink supplying device preferentially supplies the ink in the sub-tank portion.

6 Claims, 9 Drawing Sheets

STENCIL PRINTING MACHINE

BACKGROUND OF THE INVENTION

1. Field of the Invention

The present invention relates to a stencil printing machine which conveys a print medium while pressing the print medium to a drum on which a stencil sheet is mounted, and transfers an ink oozing from perforations of the stencil sheet onto the print medium.

2. Description of the Related Art

As a conventional printing method of a stencil printing machine, there are an inner press method (refer to Japanese Patent Laid-Open Publication No. Hei 7-132675 (published in 1995)) and an outer press method (refer to Japanese Patent Laid-Open Publication No. 2001-246828).

The inner press method is briefly described. As shown in FIG. 1, a drum 100 and a back press roller 101 are provided, and the drum 100 and the back press roller 101 are provided so as to be freely rotatable individually in a state where outer peripheral surfaces thereof are partially made substantially adjacent to each other. A stencil clamping portion 100*a* which clamps a tip end of a stencil sheet 104 is provided on the outer peripheral surface of the drum 100, and an outer peripheral wall other than the stencil clamping portion 100*a* is formed of a screen 102 which is flexible and ink permeable.

An ink supply mechanism 105 is provided inside the drum 100. As shown in FIG. 2, this ink supply mechanism 105 includes an inner press roller 106 which is an ink supply roller, and the inner press roller 106 is provided on a roller support member 107 so as to be freely rotatable. The inner press roller 106 is configured to be shiftable between a press position where the roller support member 107 is energized in a direction of an arrow a of FIG. 2 to press an inner peripheral surface of the screen 102 and a standby position where the roller support member 107 is rotated in a direction of an arrow b of FIG. 2 to be spaced from the inner peripheral surface of the screen 102. The inner press roller 106 is set at the press position when a print sheet 111 passes therethrough, and otherwise, set at the standby position. Moreover, the inner press roller 106 has a function to apply printing pressure from an inner periphery side of the screen 102.

The roller support member 107 is supported so as to be freely rotatable about a support shaft 108, and a doctor roller 109 and a drive rod 110 are individually provided on the roller support member 107. The doctor roller 109 has a cylindrical shape, and is fixed to the roller support member 107 at a position close to the inner press roller 106. The drive rod 110 is supported on the roller support member 107 so as to be freely rotatable, and is placed in an upper space composed of outer peripheral surfaces of the inner press roller 106 and the doctor roller 109 on sides thereof adjacent to each other. An ink 103 is supplied from an ink supply portion (not shown) to the upper space.

Next, printing operations are schematically described in order. The stencil sheet 104 on which a perforated image is formed is attached onto an outer peripheral surface of the screen 102. Then, during a printing mode, the drum 100 and the back press roller 101 are rotated in synchronization with each other in directions shown in arrows in FIG. 1, and the print sheet 111 is fed between the drum 100 and the back press roller 101.

When the print sheet 111 is fed, the inner press roller 106 presses the screen 102, and the inner press roller 106 rotates following the drum 100 in such a pressing state. The ink 103 having passed through a gap between the inner press roller 106 and the doctor roller 109 is adhered onto the outer peripheral surface of the inner press roller 106, and the ink 103 thus adhered is sequentially supplied to an inner surface of the screen 102 by the rotation of the inner press roller 106.

Moreover, when the inner press roller 106 presses the screen 102, the screen 102 swells out to the outer periphery side thereof by pressing force at this time, and the screen 102 is put into a press-contact state with the back press roller 101. Then, the print sheet 111 conveyed between the drum 100 and the back press roller 101 is conveyed while being brought into press contact with the screen 102 and the stencil sheet 104 in between the inner press roller 106 and the back press roller 101. By press-contact force at this time, the ink 103 on the screen 102 side is transferred to the print sheet 111 side from perforations of the stencil sheet 104, and an ink image is printed on the print sheet 111.

The outer press method is briefly described. As shown in FIG. 3, a drum 120 is provided. A stencil clamping portion 120*a* which clamps the tip end of the stencil sheet 104 is provided on an outer peripheral surface of this drum 120, and an outer peripheral wall 120*b* other than the stencil clamping portion 120*a* is formed of an ink permeable member with a porous structure.

An ink supply mechanism 125 is provided inside the drum 120. The ink supply mechanism 125 includes a squeegee roller 126 supported so as to be freely rotatable, and a doctor roller 127 placed adjacent to the squeegee roller 126. An ink 128 accumulates in an outer peripheral space surrounded by the squeegee roller 126 and the doctor roller 127. The ink 128 adhered onto the outer periphery of the rotating squeegee roller 126 passes through a gap between the squeegee roller 126 and the doctor roller 127, and thus only the ink 128 with a predetermined film thickness is adhered onto the squeegee roller 126, and the ink 128 with the predetermined film thickness is supplied to an inner surface of the outer peripheral wall 120*b*.

Moreover, a pressure roller 130 is provided at a position opposite to the squeegee roller 126, which is also an outside position of the drum 120. The pressure roller 130 is configured to be shiftable between a press position of pressing the outer peripheral wall 120*b* of the drum 120 and a standby position of being spaced from the outer peripheral wall 120*b* of the drum 120. The squeegee roller 126 is fixed to a support member which supports the outer peripheral wall 120*b* of the drum 120 so as to be freely rotatable, and an outer peripheral surface of the squeegee roller 126 and the inner peripheral surface of the outer peripheral wall 120*b* of the drum 120 are brought into a state of being slightly spaced from each other in a state where the outer peripheral wall 120*b* of the drum 120 is not pressed by the pressure roller 130. When the outer peripheral wall 120*b* of the drum 120 is pressed by the pressure roller 130, the outer peripheral wall 120*b* of the drum 120 is bent, and thus the outer peripheral surface of the squeegee roller 126 and the inner peripheral surface of the outer peripheral wall 120*b* of the drum 120 are brought into contact with each other.

Next, printing operations are schematically described in order. The stencil sheet 104 on which the perforated image is formed is attached onto an outer peripheral surface of the outer peripheral wall 120*b* of the drum 120. Then, during the printing mode, the outer peripheral wall 120*b* of the drum 120 is rotated in a direction shown by an arrow in FIG. 3, and the print sheet 111 is fed between the drum 120 and the pressure roller 130.

When the print sheet 111 is fed, the pressure roller 130 presses the outer peripheral wall 120*b* of the drum 120, and the outer peripheral wall 120*b* is shifted toward an inner periphery side thereof. The outer peripheral wall 120*b* is brought into a pressed state on the squeegee roller 126 by such shifting, and the squeegee roller 126 rotates following the drum 120. Onto the outer peripheral surface of the squeegee roller 126, the ink 128 having passed through the gap between the squeegee roller 126 and the doctor roller 127 is adhered. The ink 128 thus adhered is sequentially supplied to an inner surface of the outer peripheral wall 120*b* by the rotation of the squeegee roller 126.

Moreover, when the pressure roller 130 presses the outer peripheral wall 120*b* of the drum 120, the print sheet 111 conveyed between the drum 120 and the pressure roller 130 is conveyed while being brought into press contact with the stencil sheet 104 in between the squeegee roller 126 and the pressure roller 130. By press-contact force at this time, the ink 128 on the outer peripheral wall 120*b* side is transferred to the print sheet 111 side from the perforations of the stencil sheet 104, and an ink image is printed on the print sheet 111.

Incidentally, in the stencil printing machines of the conventional inner press method and outer press method, ink pools are individually formed in the outer peripheral space of the inner press roller 106 and the doctor roller 109 and in the outer peripheral space of the squeegee roller 126 and the doctor roller 127, and the inks 103 and 128 in the ink pools are supplied to the screen 102 and outer peripheral wall 120*b* of the drums 100 and 120 at the time of printing. Hence, when the printing is not performed for a long time, the inks 103 and 128 having accumulated in the ink pools and the inks 103 and 128 adhered onto the drums 100 and 120 and the like are left standing in a state of being in contact with the atmosphere, and there is a problem that the inks 103 and 128 are degraded.

SUMMARY OF THE INVENTION

In this connection, the applicant of the present invention has proposed a stencil printing machine, which includes: a drum which is freely rotatable and has an outer peripheral wall formed of an ink impermeable member, in which a stencil sheet is mounted on a surface of the outer peripheral wall; an ink supplying device which has an ink supply port at a position upstream of the maximum printing area of the outer peripheral wall of the drum in the printing direction, and supplies an ink from the ink supply port to the surface of the outer peripheral wall; an ink recovery device which has an ink recovery port at a position downstream of the maximum printing area of the outer peripheral wall of the drum in the printing direction, and recovers, from the ink recovery port, an extra ink on the surface of the outer peripheral wall; and a pressure roller which presses a print medium fed thereto to the outer peripheral wall.

In the stencil printing machine described above, when the print medium is fed thereto in a state where the outer peripheral wall of the drum is rotated and the ink is supplied from the ink supply port to the surface of the outer peripheral wall, the print medium is conveyed while being pressed to the stencil sheet and the outer peripheral wall of the drum by the pressure roller. Meanwhile, the ink between the outer peripheral wall of the drum and the stencil sheet is diffused downstream in the printing direction while being squeezed by pressing force of the pressure roller. In addition, the ink thus diffused oozes out of perforations of the stencil sheet, and is transferred to the print sheet. In the manner described above, an ink image is printed on the print sheet. Accordingly, the ink supplied to the drum is held in a substantially hermetically sealed space between the outer peripheral wall of the drum and the stencil sheet, and is prevented as much as possible from being brought into contact with the atmosphere. Hence, even if the printing is not performed for a long time, the ink can be prevented as much as possible from being degraded.

Moreover, with regard to the ink, a circulation system is configured, in which the ink in the ink tank is supplied to the drum by the ink supplying device, and an ink unused in the drum is recovered to the ink tank by the ink recovery device one more time. Accordingly, utilization efficiency of the ink is excellent, and the recovered ink can be automatically used for the next printing and after.

However, the property of the ink recovered from the drum is degraded in comparison with that of the unused ink. Therefore, when the ink in the ink tank runs short and the ink tank is refilled with new ink (including the case of changing to a new ink bottle), the printing is executed mostly by means of the recovered ink immediately before the ink refilling described above, and on the contrary, the printing is executed mostly by means of the new ink immediately after the ink refilling. Hence, there is a problem that a printed state of the printed sheets largely differs before and after the ink refilling.

In this connection, it is an object of the present invention to provide a stencil printing machine capable of obtaining substantially even printed sheets in which the printed state does not change very much even after the ink refilling.

In order to achieve the foregoing object, a first aspect of the present invention provides a stencil printing machine, which includes: a drum which is freely rotatable and has an outer peripheral wall formed of an ink impermeable member, in which a stencil sheet is mounted on a surface of the outer peripheral wall; an ink supplying device which has an ink supply portion provided on the outer peripheral wall of the drum and has an ink tank storing ink, and supplies the ink from the ink supply portion to the surface of the outer peripheral wall, the ink being guided from the ink tank; an ink recovery device which has an ink recovery portion on the outer peripheral wall of the drum, and recovers, from the ink recovery portion, an extra ink on the surface of the outer peripheral wall; and a pressure roller which presses a print medium fed thereto to the outer peripheral wall, wherein the ink tank includes a main tank portion where unused ink is stored, and a sub-tank portion where the ink recovered by the ink recovery device is stored, and the ink supplying device preferentially supplies the ink in the sub-tank portion.

In the stencil printing machine, even if the ink in the ink tank runs short and the main tank portion is refilled with new ink, the ink in the sub-tank portion is preferentially supplied to the drum, and the ink in the main tank portion is supplied only in an auxiliary manner. Hence, the printed state of the printed sheets does not change very much even after the ink refilling, and the substantially even printed sheets can be obtained.

In a preferred embodiment of the present invention, the ink supplying device may supply the ink in the sub-tank portion to the ink supply portion, and may refill the sub-tank portion from the main tank portion with an ink of an amount used in the drum.

In the stencil printing machine, the recovered ink can be preferentially used without fail.

Moreover, the main tank portion and the sub-tank portion may be configured to freely flow the ink therebetween, and chamber pressure in the main tank portion and chamber pressure in the sub-tank portion may be set equal to each other.

With such a configuration, the preferential supply of the ink can be realized with a simple configuration where the chamber pressures of both of the tank portions are merely kept equal to each other.

Moreover, the main tank portion and the sub-tank portion may be able to supply the ink to the drum though a pipe for the main tank portion and a pipe for the sub-tank portion, respectively, and pipe resistance from the main tank portion may be set larger than pipe resistance from the sub-tank portion.

With such a configuration, the preferential supply of the ink can be realized with a simple configuration where a pipe resistance difference is merely provided between both of the tank portions.

Furthermore, the ink tank may be placed inside the drum.

With such a configuration, it is not necessary to place various rollers for supplying the ink, an ink pool and the like in the drum. Accordingly, a space for installing the ink tank can be reserved largely. Moreover, the entire machine can be made compact by installing the ink tank inside the drum.

DETAILED DESCRIPTION OF THE PREFERRED EMBODIMENTS

An embodiment of the present invention is described below based on the drawings.

Figure 1:
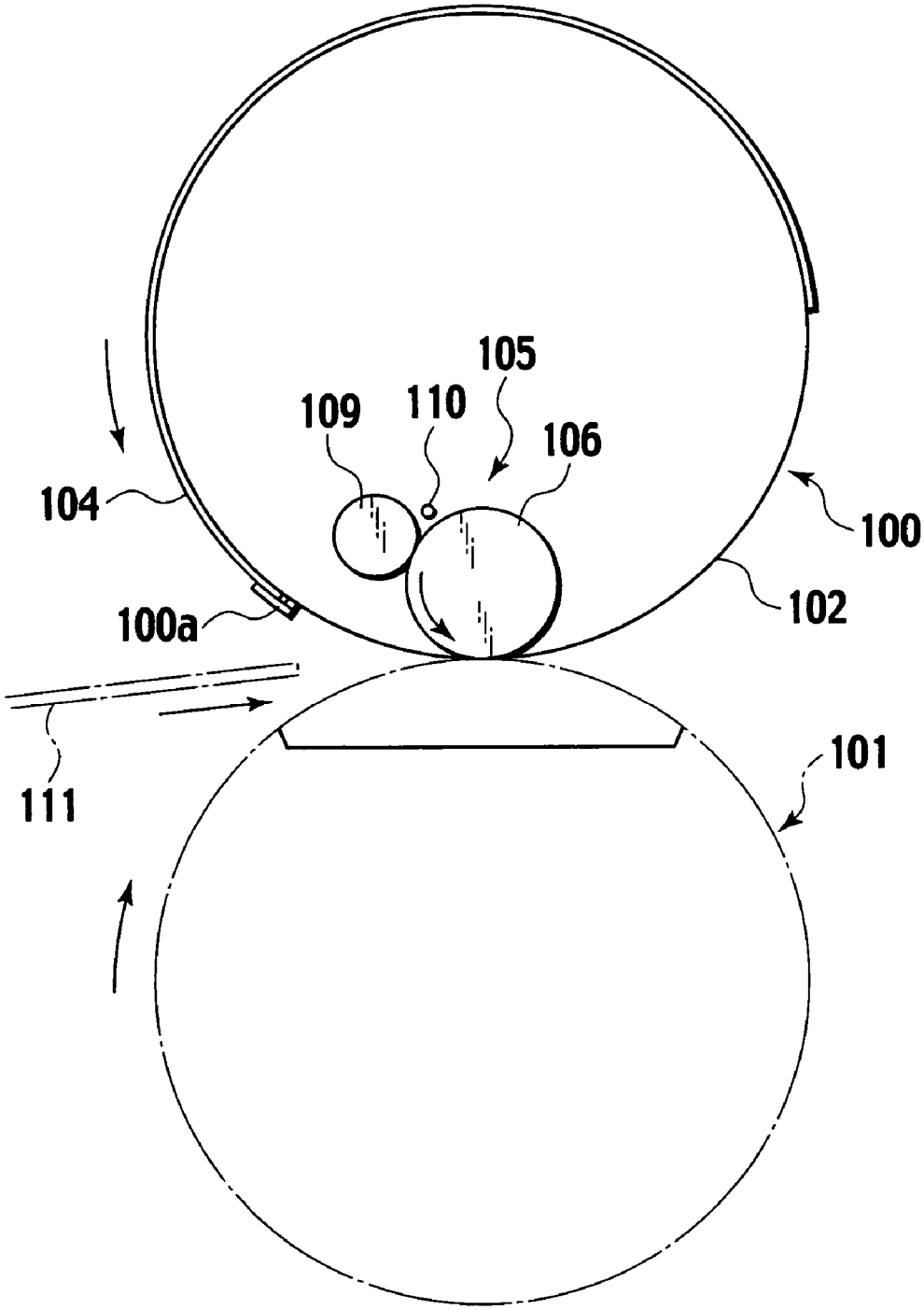
FIG.1 PRIOR ART
FIG. 1 is a schematic view of principal portions for printing according to an inner press method of a conventional example.
Figure 2:
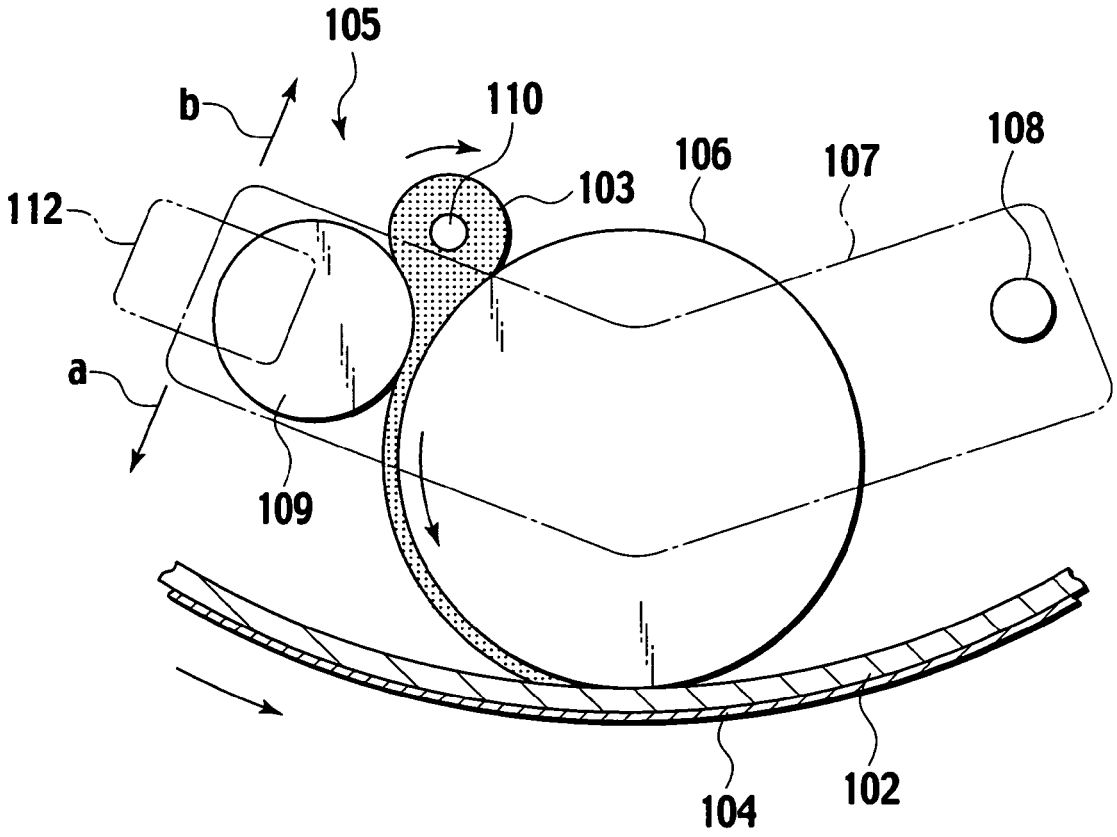
FIG.2 PRIOR ART
FIG. 2 is a schematic view of an ink supplying device according to the inner press method of the conventional example.
Figure 3:
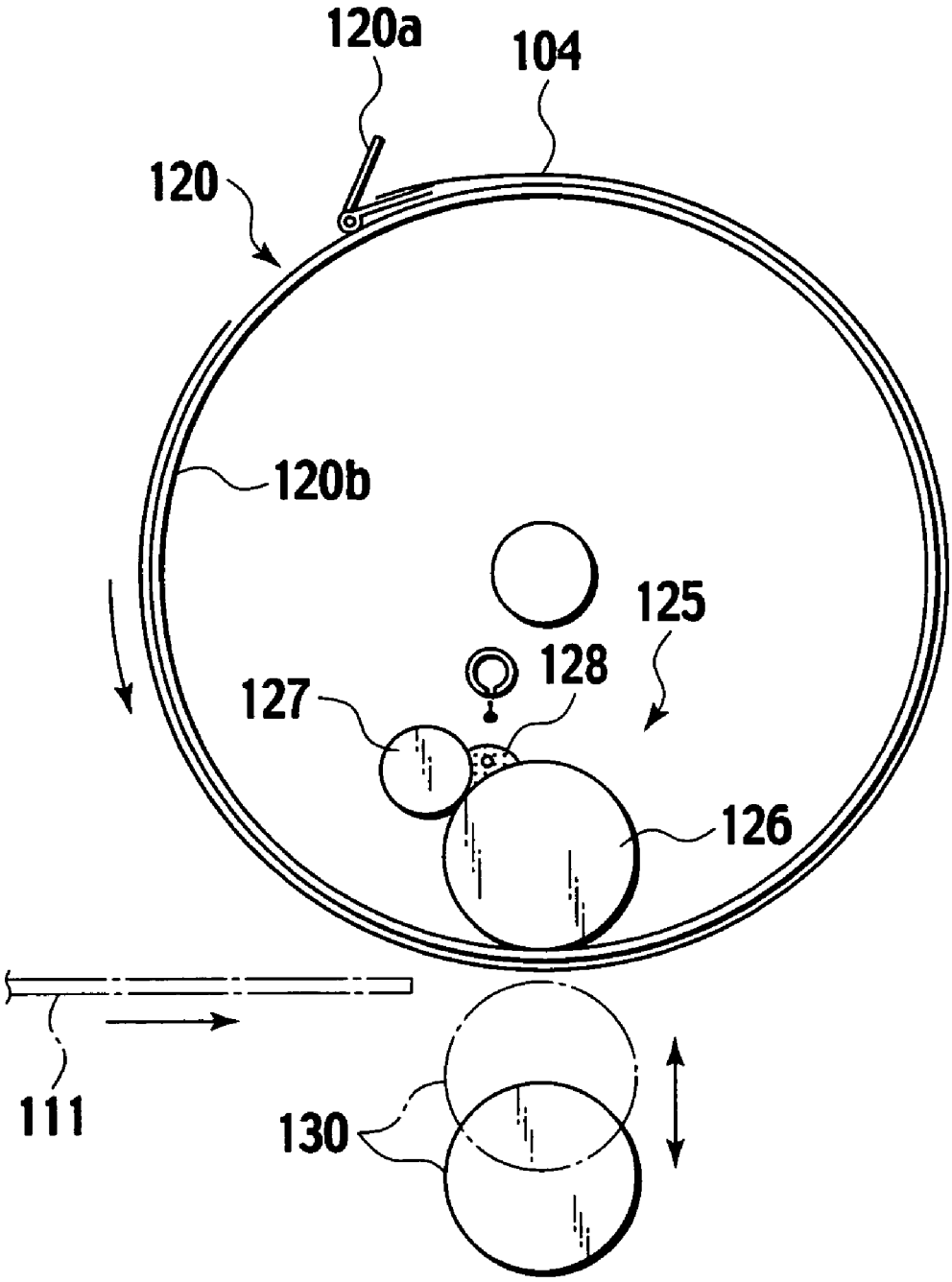
FIG.3 PRIOR ART
FIG. 3 is a schematic view of principal portions for printing according to an outer press method according to the conventional example.
Figure 4:
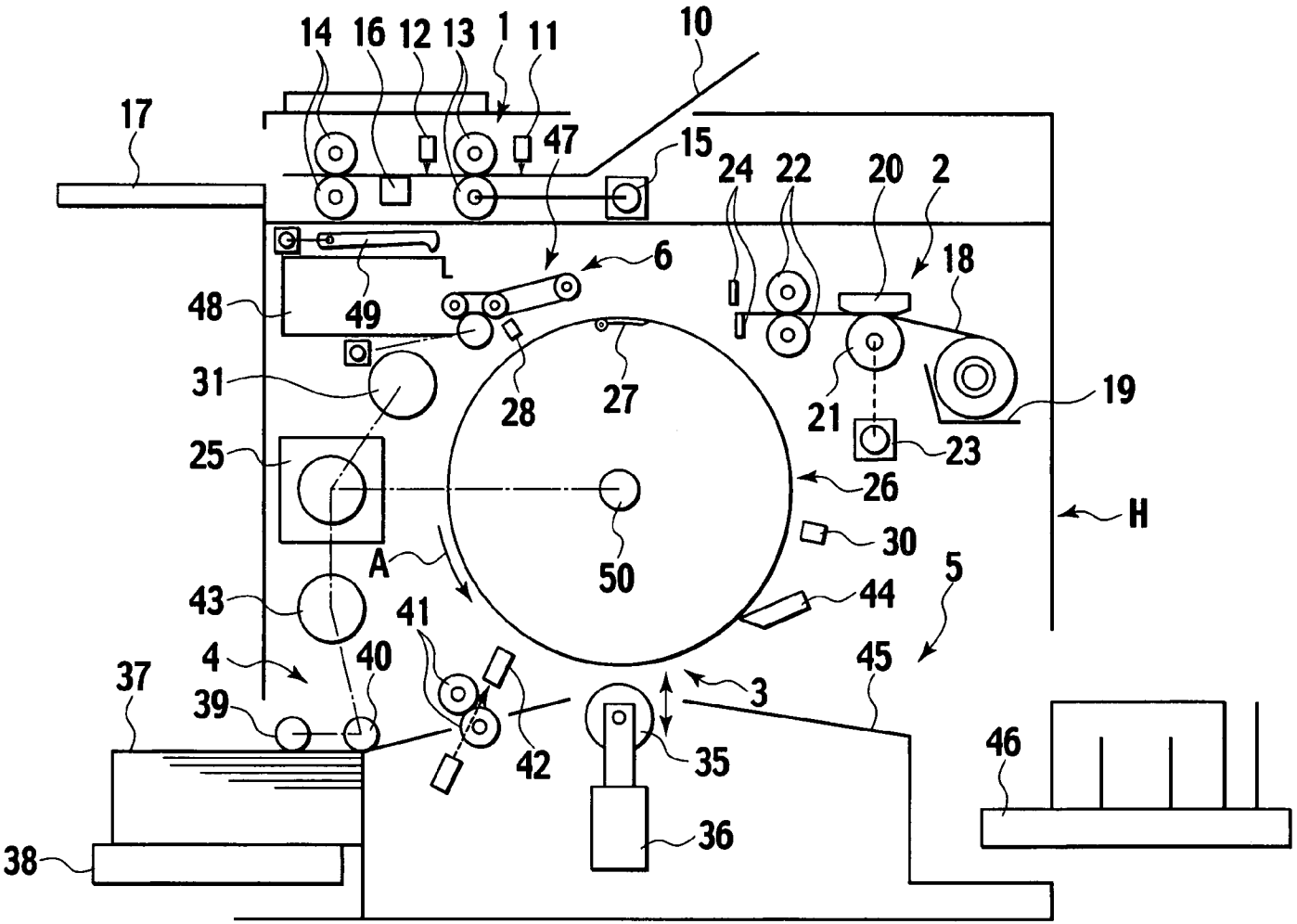
FIG. 4 shows an embodiment of the present invention, and is a schematic configuration view of a stencil printing machine.

As shown in FIG. 4, a stencil printing machine is mainly composed of an original reading unit 1, a stencil making unit 2, a printing unit 3, a paper feed unit 4, a paper discharge unit 5, and a stencil disposal unit 6.

The original reading unit 1 includes an original setting tray 10 on which an original to be printed is mounted, reflective-type original sensors 11 and 12 which detect the presence of the original on the original setting tray 10, original conveyer rollers 13 and 14 which convey the original on the original setting tray 10, a stepping motor 15 which rotationally drives the original conveyer rollers 13 and 14, a contact image sensor 16 which optically reads image data of the original conveyed by the original conveyer rollers 13 and 14 and converts the read data into electrical signals, and an original discharge tray 17 on which the original discharged from the original setting tray 10 is mounted. The original mounted on the original setting tray 10 is conveyed by the original conveyer rollers 13 and 14, and the image sensor 16 reads the image data of the conveyed original.

The stencil making unit 2 includes a stencil housing 19 which houses a long and rolled stencil sheet 18, a thermal print head 20 placed downstream of the stencil housing 19 in a conveying direction, a platen roller 21 placed at a position opposite to the thermal print head 20, a pair of stencil transfer rollers 22 and 22 placed downstream of the platen roller 21 and the thermal print head 20 in the conveying direction, a write pulse motor 23 which rotationally drives the platen roller 21 and the stencil transfer rollers 22 and 22, and a stencil cutter 24 placed downstream of the pair of stencil transfer rollers 22 and 22 in the conveying direction.

The long stencil sheet 18 is conveyed by the rotation of the platen roller 21 and the stencil transfer rollers 22 and 22. Based on the image data read by the image sensor 16, each of dot-shaped heating elements of the thermal print head 20 selectively performs a heating operation, and thus the stencil sheet 18 is perforated due to thermal sensitivity thereof to make a stencil. Then, the stencil sheet 18 thus made is cut by the stencil cutter 24 to make the stencil sheet 18 with a predetermined length.

The printing unit 3 includes a drum 26 which rotates in a direction of an arrow A of FIG. 4 by driving force of a main motor 25, a stencil clamping portion 27 which is provided on an outer peripheral surface of the drum 26 and clamps a tip end of the stencil sheet 18, a stencil confirming sensor 28 which detects whether or not the stencil sheet 18 is wound and attached around the outer peripheral surface of the drum 26, a reference position detecting sensor 30 which detects a reference position of the drum 26, and a rotary encoder 31 which detects rotation of the main motor 25. Based on a detection output of the reference position detecting sensor 30, a pulse outputted from the rotary encoder 31 is detected, thus enabling a rotation position of the drum 26 to be detected.

Moreover, the printing unit 3 includes a pressure roller 35 placed below the drum 26. The pressure roller 35 is constructed to be shiftable between a press position of pressing the outer peripheral wall of the drum 26 by driving force of a solenoid device 36 and a standby position of being spaced from the outer peripheral surface of the drum 26. The pressure roller 35 is always located at the press position during a period of a printing mode (including a trial print mode) and located at the standby position during a period other than the period of the printing mode.

Then, the tip end of the stencil sheet 18 conveyed from the stencil making unit 2 is clamped by the stencil clamping portion 27, and the drum 26 is rotated in such a clamping state, so that the stencil sheet 18 is wound and attached around the outer peripheral surface of the drum 26. Then, print sheets (print media) 37, which are fed by the paper feed unit 4 in synchronization with the rotation of the drum 26, are pressed to the stencil sheet 18 wound around the drum 26 by the pressure roller 35. Thus, an ink 56 is transferred from perforations of the stencil sheet 18 onto the print sheets 37, and an image is printed thereon.

The paper feed unit 4 includes a paper feed tray 38 on which the print sheets 37 are stacked, first paper feed rollers 39 and 40 which convey only the uppermost print sheet 37 from the paper feed tray 38, a pair of second paper feed rollers 41 and 41 which convey the print sheet 37, which has been conveyed by the first paper feed rollers 39 and 40, between the drum 26 and the pressure roller 35 in synchronization with the rotation of the drum 26, and a paper feed sensor 42 which detects whether or not the print sheet 37 has been conveyed between the pair of second paper feed rollers 41 and 41. The first paper feed rollers 39 and 40 are constructed such that the rotation of the main motor 25 is selectively transmitted thereto through a paper feed clutch 43.

The paper discharge unit 5 includes a sheet separator claw 44 which separates the printed print sheets 37 from the drum 26, a conveying passage 45 through which the print sheets 37 separated from the drum 26 by the sheet separator claw 44 are conveyed, and a paper receiving tray 46 on which the print sheets 37 discharged from the conveying passage 45 are mounted.

The stencil disposal unit 6 includes a disposed stencil conveying device 47, a stencil disposal box 48, and a disposed stencil compression member 49. The disposed stencil conveying device 47 guides the tip end of the stencil sheet 18, of which clamping has been released from the outer peripheral surface of the drum 26, and conveys the used stencil sheet 18 thus guided while peeling off the same stencil sheet 18 from the drum 26. The stencil disposal box 48 houses the stencil sheet 18 conveyed by the disposed stencil conveying device 47. The disposed stencil compression member 49 pushes the stencil sheet 18, which has been conveyed by the disposed stencil conveying device 47 into the stencil disposal box 48, into a bottom of the stencil disposal box 48.

As shown in FIG. 5 to FIG. 8, the drum 26 includes a support shaft 50 fixed to a machine body H (shown in FIG. 4), a pair of side disks 52 and 52 supported on the support shaft 50 so as to be freely rotatable with bearings 51 interposed therebetween, respectively, and a cylindrical outer peripheral wall 53 fixed between the pair of side disks 52 and 52. The outer peripheral wall 53 is rotationally driven by rotation force of the main motor 25 integrally with the pair of side disks 52 and 52. Moreover, the outer peripheral wall 53 has enough rigidity not to be deformed when being brought into press-contact with the pressure roller 35, and is formed of an ink impermeable member which does not allow the ink 56 to permeate therethrough. Note that, depending on a type of the ink impermeable member, the outer peripheral surface of the outer peripheral wall 53 may be subjected to various kinds of surface processing known in public, such as a fluorine-contained resin coating process such as a Teflon (registered trademark) coating process, nickel plating, nickel chromium plating, fused zinc plating and anodic treatment for the purpose of forming the outer peripheral surface concerned into an even cylindrical surface.

The stencil clamping portion 27 is provided by use of a concave clamping portion 53*a* formed on the outer peripheral wall 53 along an axial direction of the support shaft 50. One end of the stencil clamping portion 27 is supported on the outer peripheral wall 53 such that the stencil clamping portion 27 is freely rotatable. The stencil clamping portion 27 is provided so as not to protrude from the outer peripheral wall 53 in a clamping state shown by a solid line in FIG. 7 and FIG. 8 while the stencil clamping portion 27 protrudes from the outer peripheral wall 53 in a clamping release state shown by a virtual line in FIG. 7 and FIG. 8. Hence, the stencil clamping portion 27 is configured to be capable of clamping the stencil sheet 18 without protruding from the outer peripheral wall 53.

Figure 5:
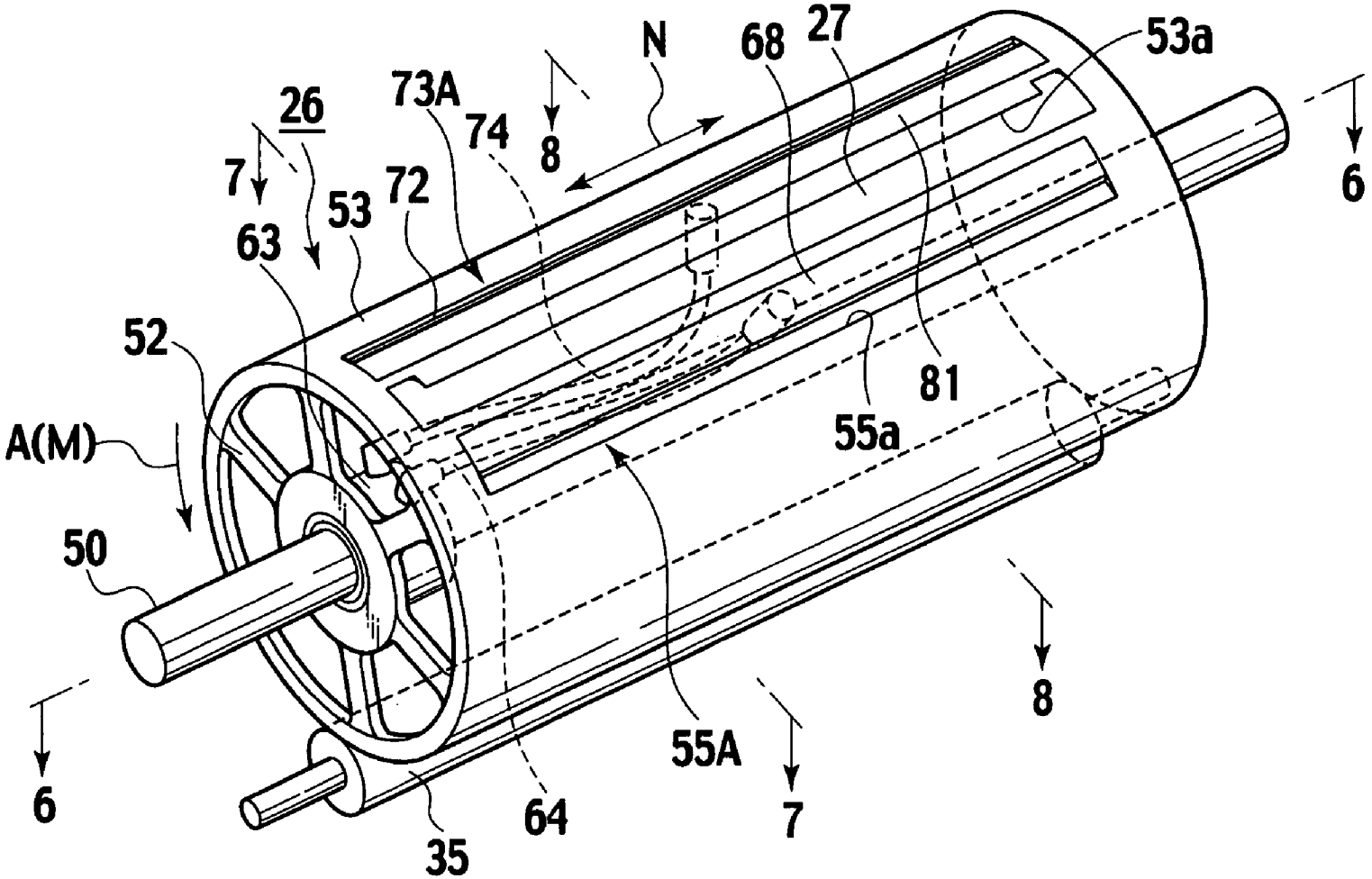
FIG. 5 shows the embodiment of the present invention, and is a perspective view of a drum.
Figure 7:
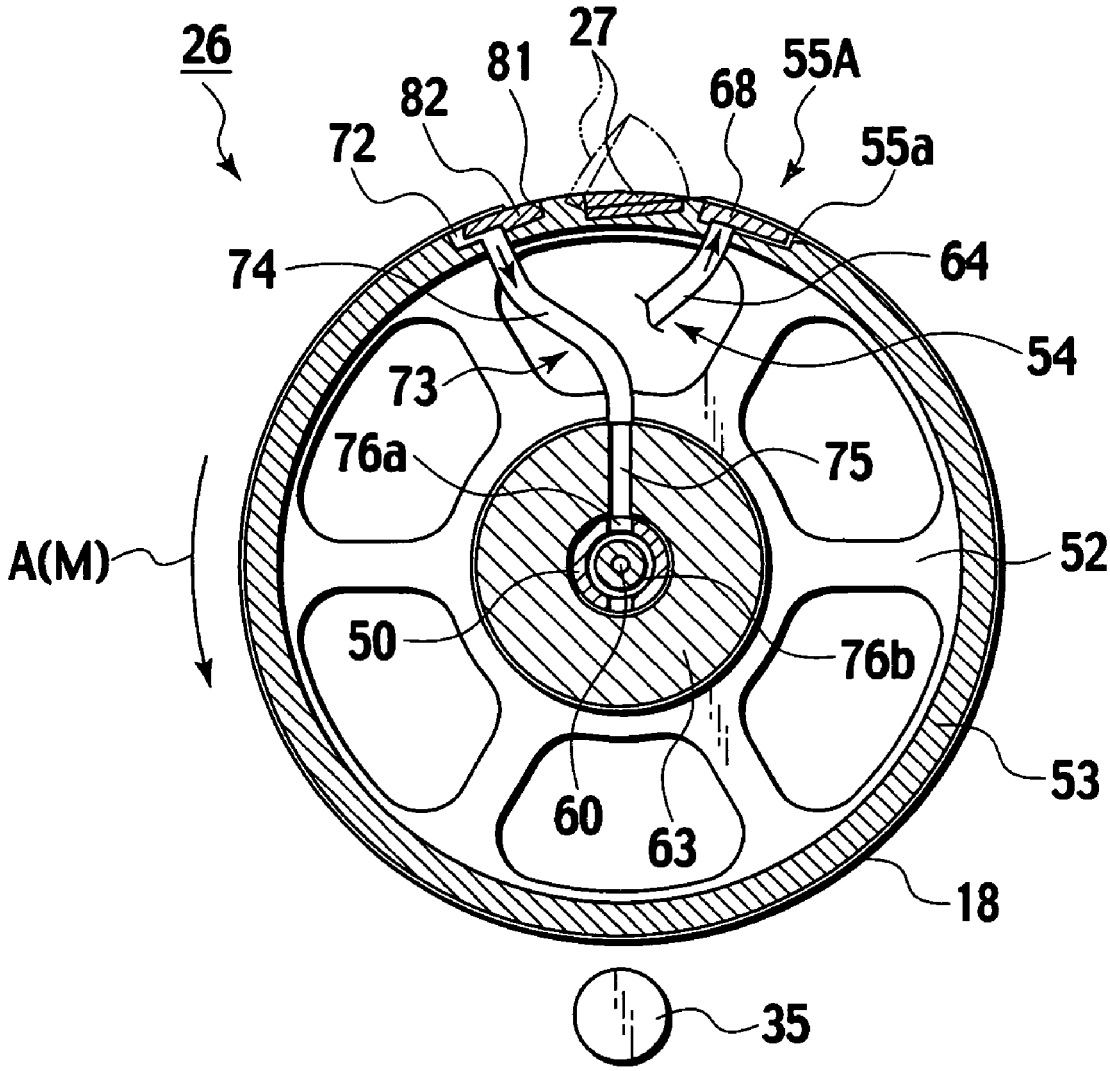
FIG. 7 shows the embodiment of the present invention, and is a cross-sectional view along a line 7—7 in FIG. 5.
Figure 8:
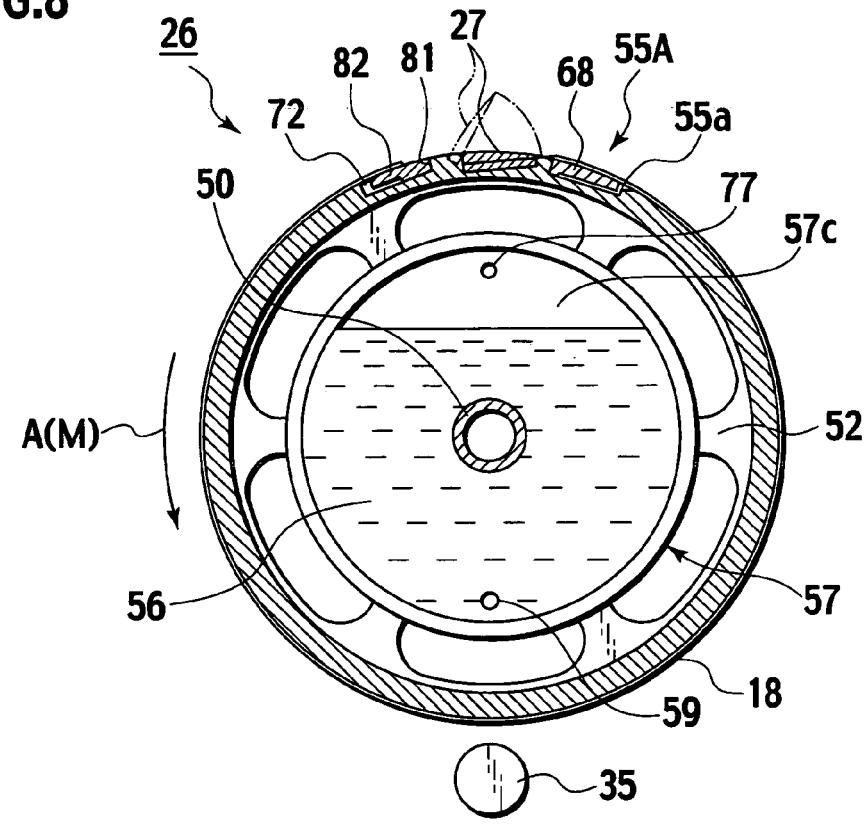
FIG. 8 shows the embodiment of the present invention, and is a cross-sectional view along a line 8—8 in FIG. 5.

The outer peripheral wall 53 is rotated in the direction of the arrow A of FIG. 5, FIG. 7 and FIG. 8, and a position thereof rotated a little from the stencil clamping portion 27 is set at a printing start point. Hence, the rotation direction A becomes a printing direction M, and an area that follows the printing start point is set as a printing area. In this embodiment, the maximum printing area is set at a region sufficient for printing an A3-size sheet. Moreover, an ink supply portion 55A of an ink supplying device 54 and an ink recovery portion 72 of an ink recovery device 73 are provided on the outer peripheral wall 53.

As shown in FIG. 5 to FIG. 8, the ink supplying device 54 includes an ink tank 57 in which the ink 56 is stored, a supply pump 58 which suctions the ink 56 in the ink tank 57, a first pipe 59 which supplies the ink 56 suctioned by the supply pump 58, the support shaft 50 to which the other end of the first pipe 59 is connected and in which an ink passage 60 is formed and a hole 61 is formed at a position 180 degrees opposite thereto, a rotary joint 63 which is supported on an outer periphery of the support shaft 50 so as to be freely rotatable and in which a through hole 62 that is able to communicate with the hole 61 is formed, a second pipe 64 in which one end thereof is connected to the rotary joint 63 and the other end thereof is guided to the outer peripheral wall 53, and the ink supply portion 55A to which the other end of the second pipe 64 is made open.

Figure 9:
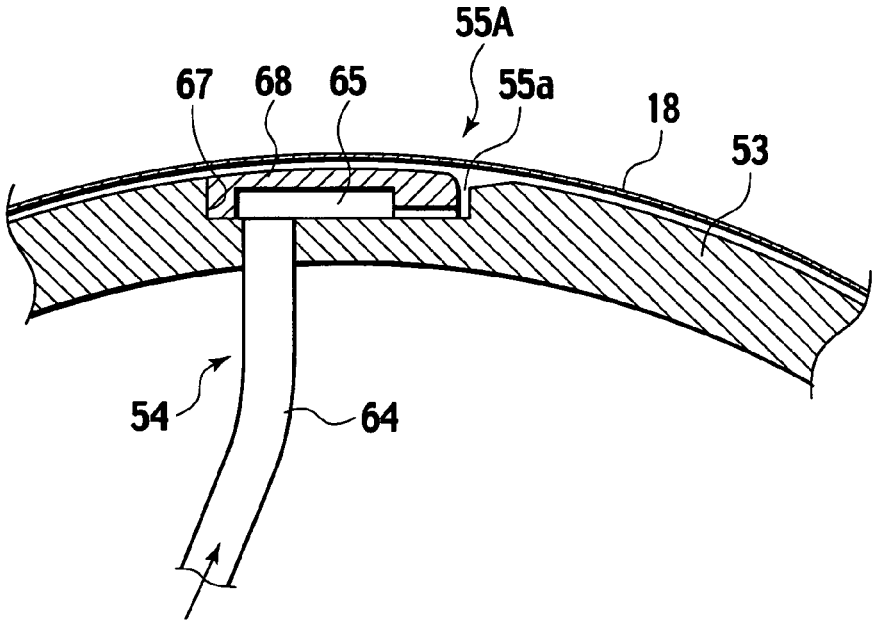
FIG. 9 shows the embodiment of the present invention, and is an enlarged cross-sectional view of an ink supply portion and a vicinity thereof.

The ink supply portion 55A is composed of an ink diffusion groove 65 which diffuses the ink 56 from the second pipe 64 in a perpendicular-to-printing direction N, and an ink supply port 55*a* as an ink diffusion/supply portion in which one end is made open to the ink diffusion groove 65 at an equal interval in the perpendicular-to-printing direction N and the other end is made open to the surface of the outer peripheral wall 53. As shown in FIG. 9, the ink diffusion groove 65 and the ink supply port 55*a* are formed of an ink supplying concave portion 67 formed along a direction perpendicular to the printing direction M (that is, perpendicular-to-printing direction N) of the outer peripheral wall 53, and of an ink distribution member 68 placed inside the ink supplying concave portion 67. The ink supply port 55*a* is formed along the perpendicular-to-printing direction N, and configured to supply the ink 56 substantially evenly in the perpendicular-to-printing direction N of the outer peripheral wall 53.

Here, the placed position of the ink supply portion 55A may be any of a position upstream of the maximum printing area in the printing direction, a position on a border partitioning the maximum printing area and a non-printing area further upstream thereof, and an upstream position in the printing direction in the maximum printing area. Note that, when the ink supply portion 55 is placed at the position upstream of the maximum printing area in the printing direction, the placed position thereof is set at a position downstream of the stencil clamping portion 27 in the printing direction. Moreover, when the ink supply portion 55A is placed in the maximum printing area, the placed position thereof is set at a position where the ink 56 supplied to the surface of the outer peripheral wall 53 is at least diffusible onto the border partitioning the maximum printing area and the non-printing area further upstream thereof.

Figure 6:
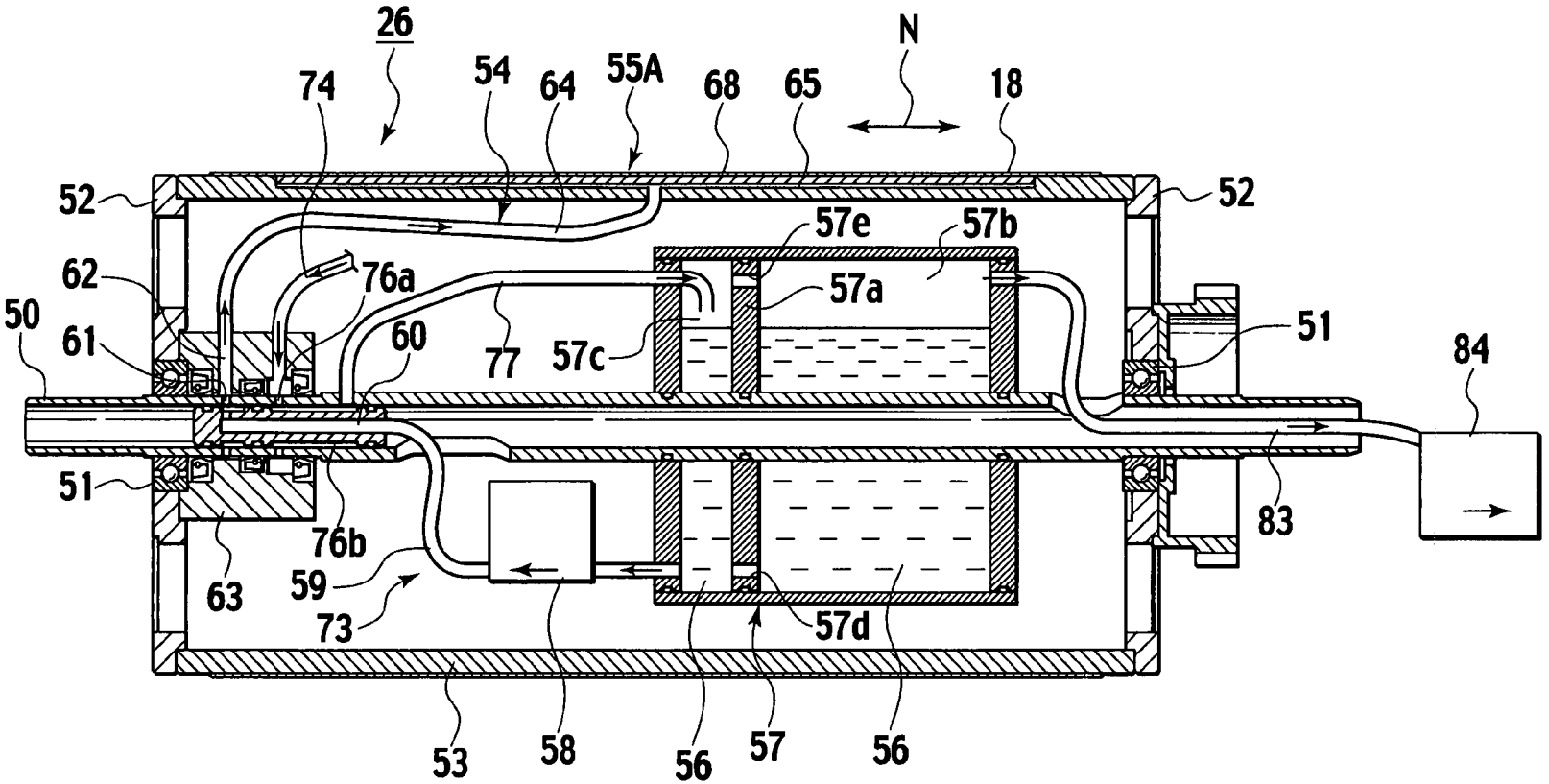
FIG. 6 shows the embodiment of the present invention, and is a cross-sectional view along a line 6—6 in FIG. 5.

As shown in FIG. 5 to FIG. 7, the ink recovery device 73 is composed of the ink recovery port 72 as an ink recovery portion open at a position downstream of the maximum printing area of the outer peripheral wall 53 in the printing direction, a third pipe 74 in which one end is connected to the ink recovery port 72, the rotary joint 63 to which the other end of the third pipe 74 is connected and in which a communication hole 75 is formed, the support shaft 50, a fourth pipe 77 in which one end is connected to the support shaft 50, the ink tank 57 to which the other end of the fourth pipe 77 is connected, a fifth pipe 83 in which one end is connected to an upper end of the ink tank 57 and which is guided to the outside of the drum 26 through the inside of the support shaft 50, and a recovery pump 84 of a vacuum pump type, which is connected to the other end of the fifth pipe 83 and reduces pressure in the ink tank 57. Here, regarding the support shaft 50, the rotary joint 63 is supported thereon so as to be freely rotatable, a hole 76*a* to which the communication hole 75 is connectable is formed therein, and an ink passage 76*b* is formed in the inside thereof. The parts of the ink recovery device 73 except the recovery pump 84 and a part of the fifth pipe 83 are housed in the drum 26.

The ink recovery port 72 is formed by use of an ink recovery concave portion continuously formed along the perpendicular-to-printing direction N of the outer peripheral wall 53, and of a pipe fixing member 82 placed in the inside thereof. The rotary joint 63 is made to also function as one for the ink supplying device 54. The support shaft 50 is also used for the ink passage of the ink supplying device 54, and accordingly, adopts the structure of a double pipe.

Next, a configuration of the above-described ink tank 57 is described. As shown in FIG. 6 and FIG. 8, the ink tank 57 has a cylindrical shape, and is placed in the drum 26 in a state where the support shaft 50 penetrates through a center of the cylindrical shape. An inside of the ink tank 57 is partitioned into a main tank portion 57*b* and the sub-tank portion 57*c* by a partition wall 57*a*. The unused ink 56 is stored in the main tank portion 57*b*, and the main tank portion 57*b* can be refilled with the ink 56 from the outside by a user. The one end of the first pipe 59 is connected to a lower portion of the sub-tank portion 57*c*, and the ink 56 in the sub-tank portion 57*c* is supplied to the drum 26 by the ink supplying device 54. Moreover, the other end of the fourth pipe 77 is connected to an upper portion of the sub-tank portion 57*c*, and the ink 56 recovered by the ink recovery device 73 is recovered into the sub-tank portion 57*c*. Specifically, during the printing operation, the ink 56 in the sub-tank portion 57*c* is circulated by the ink supplying device 54 and the ink recovery device 73.

Moreover, in a lower portion and upper portion of the partition wall 57*a*, communication holes 57*d* and 57*e*, each of which allows the main tank portion 57*b* and the sub-tank portion 57*c* to communicate with each other, are formed, respectively. By the lower communication hole 57*d*, the ink 56 is set capable of flowing between the main tank portion 57*b* and the sub-tank portion 57*c*. The one end of the fifth pipe 83 is connected to the main stank portion 57*b*. The recovery pump 84 directly reduces pressure of the main tank portion 57*b*, and reduces pressure of the sub-tank portion 57*c* through the upper communication hole 57*e*, and the chamber pressure of the main tank portion 57*b* and the chamber pressure of the sub-tank portion 57*c* will become equal to each other at some future time. Hence, the ink 56 in the sub-tank portion 57*c* of the ink tank 57 is supplied to the outer peripheral wall 53 of the drum 26, and the ink 56 unused for the printing is recovered into the sub-tank portion 57*c*. Accordingly, the ink 56 in the sub-tank portion 57*c* is preferentially used. Then, when an amount of usage of the ink 56 in the sub-tank portion 57*c* exceeds a certain amount, that is, when a liquid level difference between both of the tank portions 57*b* and 57*c* exceeds a certain value, the ink 56 in the main tank portion 57*b* flows into the sub-tank portion 57*c* through the communication hole 57*d*, and the sub-tank portion 57*c* is refilled with the ink.

Next, operations of the stencil printing machine configured as described above are briefly described.

First, when a stencil making mode is selected, in the stencil making unit 2, the stencil sheet 18 is conveyed by the rotation of the platen roller 21 and the stencil transfer rollers 22 and 22. Based on the image data read by the original reading unit 1, a large number of heating elements of the thermal print head 20 selectively perform the heating operation, and thus the stencil sheet 18 is perforated due to the thermal sensitivity thereof to make the stencil. Then, the stencil sheet 18 thus made is cut at the predetermined spot by the stencil cutter 24. Thus, the stencil sheet 18 with the desired dimension is made.

In the printing unit 3, the tip end of the stencil sheet 18 made in the stencil making unit 2 is clamped by the stencil clamping portion 27 of the drum 26, and the drum 26 is rotated in such a clamping state, so that the stencil sheet 18 is wound, attached and loaded around the outer peripheral surface of the drum 26.

Next, when the printing mode is selected, in the printing unit 3, the drum 26 is rotationally driven, and the ink supplying device 54 and the ink recovery device 73 start driving. Then, the ink 56 in a sub-tank portion 57*c* of the ink tank 57 is supplied from the ink supply port 55*a* to the outer peripheral wall 53, and the ink 56 thus supplied is held between the outer peripheral wall 53 and the stencil sheet 18, and the pressure roller 35 is shifted from the standby position to the press position.

The paper feed unit 4 feeds the print sheets 37 between the drum 26 and the pressure roller 35 in synchronization with the rotation of the drum 26. The print sheets 37 thus fed are pressed to the outer peripheral wall 53 of the drum 26 by the pressure roller 35, and conveyed by the rotation of the outer peripheral wall 53 of the drum 26. Specifically, the print sheets 37 are conveyed while being brought into intimate contact with the stencil sheet 18.

Figure 10:
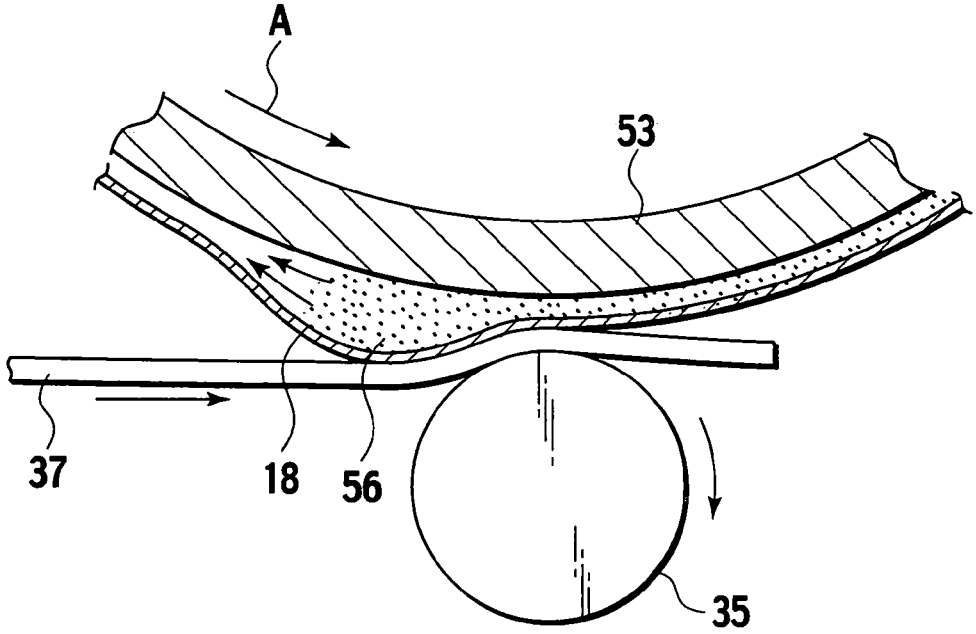
FIG. 10 shows the embodiment of the present invention, and is a partial cross-sectional view explaining a diffusion mechanism of an ink.

Moreover, at the same time when the print sheets 37 are conveyed, as shown in FIG. 10, the ink 56 held between the outer peripheral wall 53 of the drum 26 and the stencil sheet 18 is diffused downstream in the printing direction M while being squeezed by the pressing force of the pressure roller 35. The ink 56 thus diffused oozes out of the perforations of the stencil sheet 18, and is transferred to the print sheets 37. In the manner described above, the ink image is printed on the print sheets 37 in the process where the print sheets 37 pass between the outer peripheral wall 53 of the drum 26 and the pressure roller 35. With regard to the print sheets 37 which have come out from between the outer peripheral wall 53 of the drum 26 and the pressure roller 35, the tip ends thereof are peeled off from the drum 26 by the sheet separator claw 44. The print sheets 37 spaced from the drum 26 are discharged through the conveying passage 45 to the paper receiving tray 46, and are stacked there.

An extra ink which has flown downstream of the maximum printing area of the outer peripheral wall 53 during the printing operation flows into the ink recovery port 72 of the ink recovery device 73 by suction force of the recovery pump 84, and the like. The ink 56 which has flown into the ink recovery port 72 is recovered into the sub-tank portion 57*c* of the ink tank 57.

When printing of the set number of print sheets is completed, the rotation of the outer peripheral wall 53 of the drum 26 is stopped, and the drive of the ink supplying device 54 is stopped. Thus, the supply of the ink 56 to the outer peripheral wall 53 is stopped. The drive of the ink recovery device 73 is stopped a little later than the stop of the ink supplying device 54, and the extra ink which has remained on the outer peripheral wall 53 is recovered through the ink recovery port 72. Moreover, the pressure roller 35 is recovered back to the standby position from the press position, and the stencil printing machine enters a standby mode.

When making of a new stencil sheet is started and so on and stencil disposal processing is thus started, the stencil clamping portion 27 of the drum 26 is shifted to a clamping release position, and the tip end of the stencil sheet 18, of which clamping has been released, is guided to the disposed stencil conveying device 47, following the rotation of the drum 26, and housed in the stencil disposal box 48.

As described above, in the stencil printing machine, the ink 56 in the sub-tank portion 57*c* of the ink tank 57 is supplied to the outer peripheral wall 53 of the drum 26, and the ink 56 unused for the printing is recovered into the sub-tank 57*c*. Accordingly, the ink 56 in the sub-tank portion 57*c* is preferentially used. Then, when the amount of usage of the ink 56 in the sub-tank portion 57*c* exceeds a certain amount, that is, when the liquid level difference between both of the tank portions 57*b* and 57*c* exceeds a certain value, the ink 56 in the main tank portion 57*b* flows into the sub-tank portion 57*c* through the communication hole 57*e*, and the sub-tank portion 57*c* is refilled with the ink.

When such operations are repeated and the ink 56 in the ink tank 57 runs short, the user refills the main tank portion 57*b* with the unused ink 56. Even if the main tank portion 57*b* is refilled with the unused ink 56, the ink 56 in the sub-tank portion 57*c* is preferentially supplied to the drum 26, and the ink 56 in the main tank portion 57*b* is supplied only in an auxiliary manner as described above. Hence, even after the ink refilling (bottle change in the case of an ink bottle), a printed state of the printed sheets does not change very much, and substantially even printed sheets can be obtained.

In the above-described embodiment, the ink supplying device 54 is configured to preferentially supply the ink 56 in the sub-tank portion 57*c* in a manner that the ink 56 in the sub-tank portion 57*c* is supplied to the ink supply portion 55A and that the sub-tank portion 57*c* is refilled from the main tank portion 57*b* with the ink of the amount used in the drum 26. Accordingly, the recovered ink 56 can be preferentially used without fail. Specifically, when the amount of usage of the ink 56 in the sub-tank portion 57*c* exceeds a certain amount, that is, when the liquid level difference between both of the tank portions 57*b* and 57*c* exceeds a certain value, the ink 56 in the main tank portion 57*b* flows into the sub-tank portion 57*c* through the communication hole 57*e*, and the sub-tank portion 57*c* is refilled with the ink.

In the above-described embodiment, the ink supplying device 54 is configured to preferentially supply the ink 56 in the sub-tank portion 57*c* in a manner that the main tank portion 57*b* and the sub-tank portion 57*c* are set capable of flowing the ink 56 therebetween and that the chamber pressure in the main tank portion 57*b* and the chamber pressure in the sub-tank portion 57*c* are set equal to each other. Accordingly, the preferential supply of the ink 56 can be realized with a simple configuration where the chamber pressures of both of the tank portions 57*b* and 57*c* are merely kept equal to each other.

In the above-described embodiment, the ink tank 57 is placed inside the drum 26, and accordingly, it is not necessary to place various rollers for supplying the ink, an ink pool and the like in the drum 26. Therefore, a space for installing the ink tank 57 can be reserved largely. Moreover, the entire machine can be made compact by installing the ink tank 57 inside the drum 26.

In the above-described embodiment, the ink supplying device 54 and the ink recovery device 73 are always driven during the printing mode. Accordingly, the ink is continuously supplied from the ink supply portion 55A to the outer peripheral wall 53 during the printing mode, and the ink 56 which has entered the ink recovery port 72 from the outer peripheral wall 53 is always recovered. Accordingly, the ink 56 can be prevented at the earliest opportunity from residing on the outer peripheral wall 53. Moreover, an adequate amount of the ink 56 can always be held on the outer peripheral wall 53. Therefore, even when a large number of print sheets are continuously printed, printed sheets with a desired ink density can be obtained.

In the above-described embodiment, the ink supply portion 55A has the ink supply port 55*a* made continuously open along the perpendicular-to-printing direction N of the outer peripheral wall 53. Accordingly, the ink 56 is diffused without any bias in the perpendicular-to-printing direction N when the ink 56 is diffused downstream of the printing direction by being pressed by the pressure roller 35. Hence, density unevenness of the printing in the perpendicular-to-printing direction N can be surely prevented. Here, the ink supply portion 55A just has to be configured to be provided along the perpendicular-to-printing direction N of the outer peripheral wall 53 and configured to be able to supply the ink 56 substantially evenly in the perpendicular-to-printing direction N, and various configurations are conceivable. For example, the ink supply portion 55A may be configured to have plural ink supply ports made open at an equal interval along the perpendicular-to-printing direction N of the outer peripheral wall 53.

In the above-described embodiment, the ink recovery port 72 as the ink recovery portion is provided only at the portion downstream of the maximum printing area of the outer peripheral wall 53 in the printing direction. However, a configuration may be adopted, in which ink recovery grooves are provided at outer positions on left and right sides of the maximum printing area in the perpendicular-to-printing direction N, and the ink recovery grooves are continued with the ink recovery port 72. With such a configuration, an ink leaking from the sides of the maximum printing area can be recovered, and the ink leakage from the sides can be prevented. Moreover, another configuration may be adopted, in which an ink recovery groove is provided at a position which is upstream of the maximum printing area in the printing direction and downstream of the stencil clamping portion 27 in the printing direction, and the ink recovery groove is continued with the ink recovery port 72. With such a configuration, an ink leaking from the top of the maximum printing area can be recovered, and the ink leakage from the top can be prevented.

In the above-described embodiment, the stencil clamping portion 27 does not protrude from the surface of the outer peripheral wall 53 of the drum 26, and accordingly, the drive of the pressure roller 35 is easy. Specifically, during the printing mode, it is not necessary to shift the pressure roller 35 between the press position and the standby position for each rotation of the drum 26 in order to avoid collision of the pressure roller 35 against the stencil clamping portion 27. In such a way, malfunctions such as noise caused by the pressure roller 35 and image quality deterioration caused by a rebound thereof can be solved.

Figure 11:
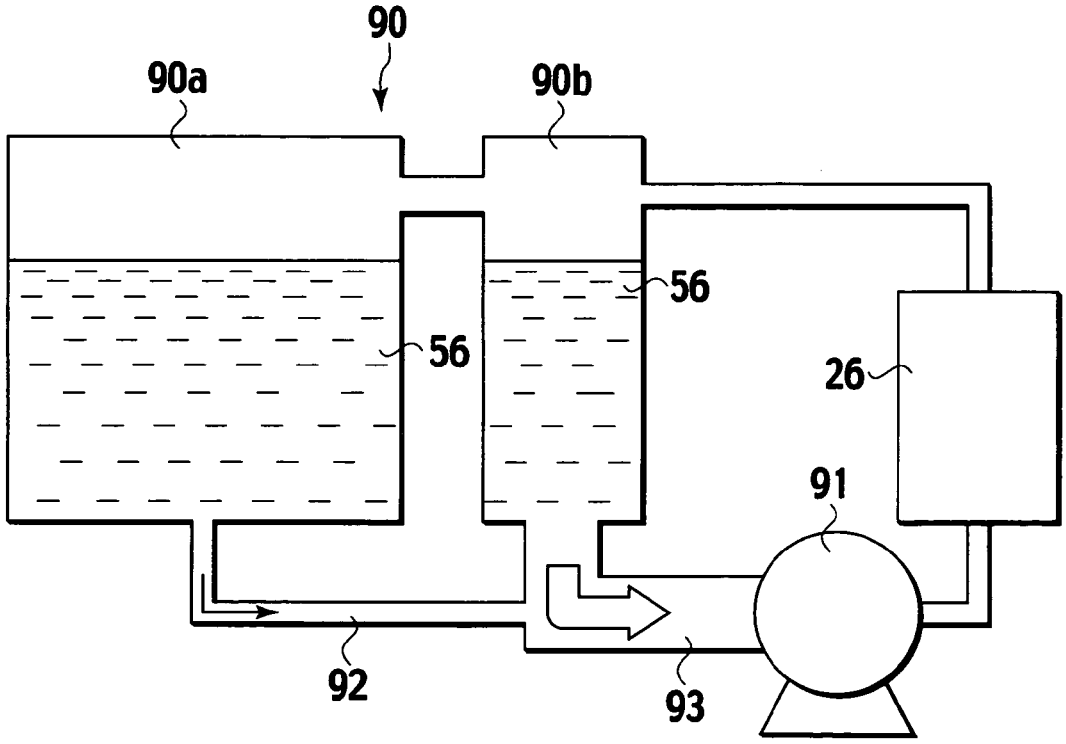
FIG. 11 shows the embodiment of the present invention, and is a system configuration view showing a modification example of supply and recovery of the ink.

FIG. 11 is a system configuration view showing a modification example of the supply and recovery of the ink.

In FIG. 11, a main tank 90 includes a main tank portion 90*a* and a sub-tank portion 90*b*, and as in the above-described embodiment, the ink 56 recovered from the drum 26 is recovered to the sub-tank portion 90*b*. However, unlike the above-described embodiment, a configuration is adopted, in which both of the ink 56 in the main tank portion 90*a* and the ink 56 in the sub-tank portion 90*b* are supplied to the drum 26 by driving force of a pump 91. In addition, pipe resistance of a pipe 92 for the main tank portion 90*a* is set larger than pipe resistance of a pipe 93 for the sub-tank portion 90*b*.

In such a supply/recovery system of the ink, unless a liquid level difference between the sub-tank portion 90*b* and the main tank portion 90*a* exceeds a certain value, the ink 56 in the sub-tank portion 90*b* is supplied to the drum 26, and the ink 56 unused for the printing is recovered into the sub-tank portion 90*b*. Accordingly, the ink 56 in the sub-tank portion 90*b* is preferentially used. Then, when the amount of usage of the ink 56 in the sub-tank portion 90*b* exceeds a certain amount, that is, when the liquid level difference between both of the tank portions 90*b* and 90*a* exceeds a certain value, the ink 56 in the main tank portion 90*a* is supplied to the drum 26 through the pipe 92 for the main tank portion 90*a*, and the sub-tank portion 90*b* is refilled with the ink.

When such operations are repeated and the ink 56 in the ink tank 90 runs short, the user refills the main tank portion 90*a* with the unused ink 56. Even if the main tank portion 90*a* is refilled with the unused ink 56, the ink 56 in the sub-tank portion 90*b* is preferentially supplied to the drum 26, and the ink 56 in the main tank portion 90*a* is supplied only in an auxiliary manner as described above. Hence, even after the ink refilling (bottle change in the case of an ink bottle), a printed state of the printed sheets does not change very much, and substantially even printed sheets can be obtained.

In the above-described modification example, a configuration is adopted, in which the ink 56 in the sub-tank portion 90*b* is preferentially supplied in a manner that the ink 56 in the sub-tank portion 90*b* is supplied to the drum 26 and that the sub-tank portion 90*b* is refilled from the main tank portion 90*a* with the ink of the amount used in the drum 26. Accordingly, the recovered ink 56 can be preferentially used without fail. Specifically, when the amount of usage of the ink 56 in the sub-tank portion 90*b* exceeds a certain amount, that is, when the liquid level difference between both of the tank portions 90*a* and 90*b* exceeds a certain value, the ink 56 in the main tank portion 90*a* flows into the drum 26 through the pipe 92 for the main tank portion 90*a*, and the sub-tank portion 90*b* is refilled with the ink.

In the above-described modification example, the main tank portion 90*a* and the sub-tank portion 90*b* are configured to freely supply the ink 56 to the drum 26 through the pipe 92 for the main tank portion 90*a* and the pipe 93 for the sub-tank portion 90*b*, respectively, and to preferentially supply the ink 56 in the sub-tank portion 90*b* in a manner that the pipe resistance from the main tank portion 90*a* is set larger than the pipe resistance from the sub-tank portion 90*b*. Accordingly, the preferential supply of the ink 56 can be realized with a simple configuration where the pipe resistance difference is merely provided between both of the tank portions 90*a* and 90*b*.

Note that, if a configuration in which the ink 56 recovered from the drum 26 passes through a filter and impurities such as paper dust in the ink are trapped by the filter is adopted in the above-described embodiment and the above-described modification example, then quality of the recovered ink can be improved.

What is claimed is:

1. A stencil printing machine, comprising:

a drum which is freely rotatable and has an outer peripheral wall formed of an ink impermeable member, in which a stencil sheet is mounted on a surface of the outer peripheral wall;

an ink supply device which has an ink supply portion provided on the outer peripheral wall of the drum and has an ink tank storing an ink, and supplies the ink from the ink supply portion to the surface of the outer peripheral wall, the ink being guided from the ink tank;

an ink recovery device which has an ink recovery portion on the outer peripheral wall of the drum, and recovers, from the ink recovery portion, an extra ink on the surface of the outer peripheral wall; and a pressure roller which presses a print medium fed thereto to the outer peripheral wall, wherein the ink tank includes a main tank portion where unused ink is stored, and a sub-tank portion where the ink recovered by the ink recovery device is stored, and the ink supply device preferentially supplies the ink in the sub-tank portion.

2. The stencil printing machine according to claim 1, wherein the ink supply device supplies the ink in the sub-tank portion to the ink supply portion, and refills the sub-tank portion from the main tank portion with an ink of an amount used in the drum.

3. The stencil printing machine according to claim 2, wherein the main tank portion and the sub-tank portion are configured to freely flow the ink therebetween, and chamber pressure in the main tank portion and chamber pressure in the sub-tank portion are set equal to each other.

4. The stencil printing machine according to claim 2, wherein the main tank portion and the sub-tank portion are able to supply the ink to the drum though a pipe for the main tank portion and a pipe for the sub-tank portion, respectively, and pipe resistance from the main tank portion is set larger than pipe resistance from the sub-tank portion.

5. The stencil printing machine according to claim 1, wherein the ink tank is placed inside the drum.

6. The stencil printing machine according to claim 1, wherein the ink supply portion supplies the ink between the outer peripheral wall and the stencil sheet.

* * * * *